US010160090B2

(12) United States Patent
Cheng et al.

(10) Patent No.: US 10,160,090 B2
(45) Date of Patent: Dec. 25, 2018

(54) CHEMICAL MECHANICAL POLISHING METHOD

(71) Applicant: TAIWAN SEMICONDUCTOR MANUFACTURING CO., LTD., Hsinchu (TW)

(72) Inventors: Chih-Lung Cheng, Hsinchu (TW); Yu-Ming Kuo, New Taipei (TW); Li-Ming Hsu, Hsinchu County (TW)

(73) Assignee: TAIWAN SEMICONDUCTOR MANUFACTURING CO., LTD., Hsinchu (TW)

( * ) Notice: Subject to any disclaimer, the term of this patent is extended or adjusted under 35 U.S.C. 154(b) by 192 days.

(21) Appl. No.: 14/939,228

(22) Filed: Nov. 12, 2015

(65) Prior Publication Data

US 2017/0136601 A1 May 18, 2017

(51) Int. Cl.

| | |
|---|---|
| ***B24B 49/14*** | (2006.01) |
| ***B24B 37/20*** | (2012.01) |
| ***B24B 37/015*** | (2012.01) |
| ***B24B 55/02*** | (2006.01) |
| *B24B 7/22* | (2006.01) |

(52) U.S. Cl.

CPC ..... *B24B 37/20* (2013.01); *B24B 37/015* (2013.01); *B24B 49/14* (2013.01); *B24B 55/02* (2013.01); *B24B 7/228* (2013.01)

(58) Field of Classification Search

CPC ..... B24B 7/228; B24B 37/015; B24B 49/14; B24B 55/02; B24B 55/03

See application file for complete search history.

(56) References Cited

U.S. PATENT DOCUMENTS

| | | | | |
|---|---|---|---|---|
| 5,775,980 | A * | 7/1998 | Sasaki | B24B 37/015 257/E21.304 |
| 6,315,635 | B1 * | 11/2001 | Lin | B24B 37/015 451/287 |
| 6,837,773 | B2 * | 1/2005 | Brunelli | B24B 49/14 257/E21.23 |
| 7,201,634 | B1 * | 4/2007 | Naujok | B24B 37/015 451/288 |
| 8,439,723 | B2 * | 5/2013 | Marks | B24B 37/015 451/53 |
| 9,616,545 | B2 * | 4/2017 | Shinozaki | G05D 23/1917 |
| 2001/0039170 | A1 * | 11/2001 | Marcyk | B24B 1/00 451/53 |
| 2001/0055940 | A1 * | 12/2001 | Swanson | B24B 37/015 451/53 |
| 2003/0073384 | A1 * | 4/2003 | Sandhu | B23Q 15/013 451/8 |

(Continued)

FOREIGN PATENT DOCUMENTS

| | | |
|---|---|---|
| CN | 201744919 A | 2/2011 |
| CN | 102419603 A | 4/2012 |

*Primary Examiner* — Timothy V Eley

(74) *Attorney, Agent, or Firm* — Maschoff Brennan

(57) ABSTRACT

A chemical mechanical polishing (CMP) apparatus includes a processing chamber, a platen, a wafer heater and a carrier head. The platen is disposed in the processing chamber and is configured to allow a polishing pad to be disposed thereon. The wafer heater is disposed in the processing chamber and is configured to heat a wafer. The carrier head is disposed in the processing chamber and is configured to hold the heated wafer against the polishing pad.

20 Claims, 3 Drawing Sheets

(56) References Cited

U.S. PATENT DOCUMENTS

| | | | | |
|---|---|---|---|---|
| 2003/0104769 | A1* | 6/2003 | Brunelli | B24B 49/14 451/53 |
| 2003/0114077 | A1* | 6/2003 | Yang | B24B 37/32 451/7 |
| 2003/0203708 | A1* | 10/2003 | Liu | B24B 37/042 451/53 |
| 2010/0279435 | A1* | 11/2010 | Xu | B24B 37/015 438/5 |
| 2010/0285723 | A1* | 11/2010 | Lin | B24B 37/107 451/5 |
| 2016/0099156 | A1* | 4/2016 | Yamaguchi | H01L 21/67028 438/692 |

* cited by examiner

CHEMICAL MECHANICAL POLISHING METHOD

BACKGROUND

The present disclosure generally relates to chemical mechanical polishing.

Chemical mechanical polishing is more commonly known as CMP. This is a process where the top surface of a wafer is polished with slurry containing abrasive grit, suspended within reactive chemical agents.

The polishing action is partially mechanical and partially chemical. The mechanical elements of the process apply downward pressure while the chemical reaction that takes place increases the material removal rate, and this is usually tailored to suit the type of material being processed.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

Figure 1:
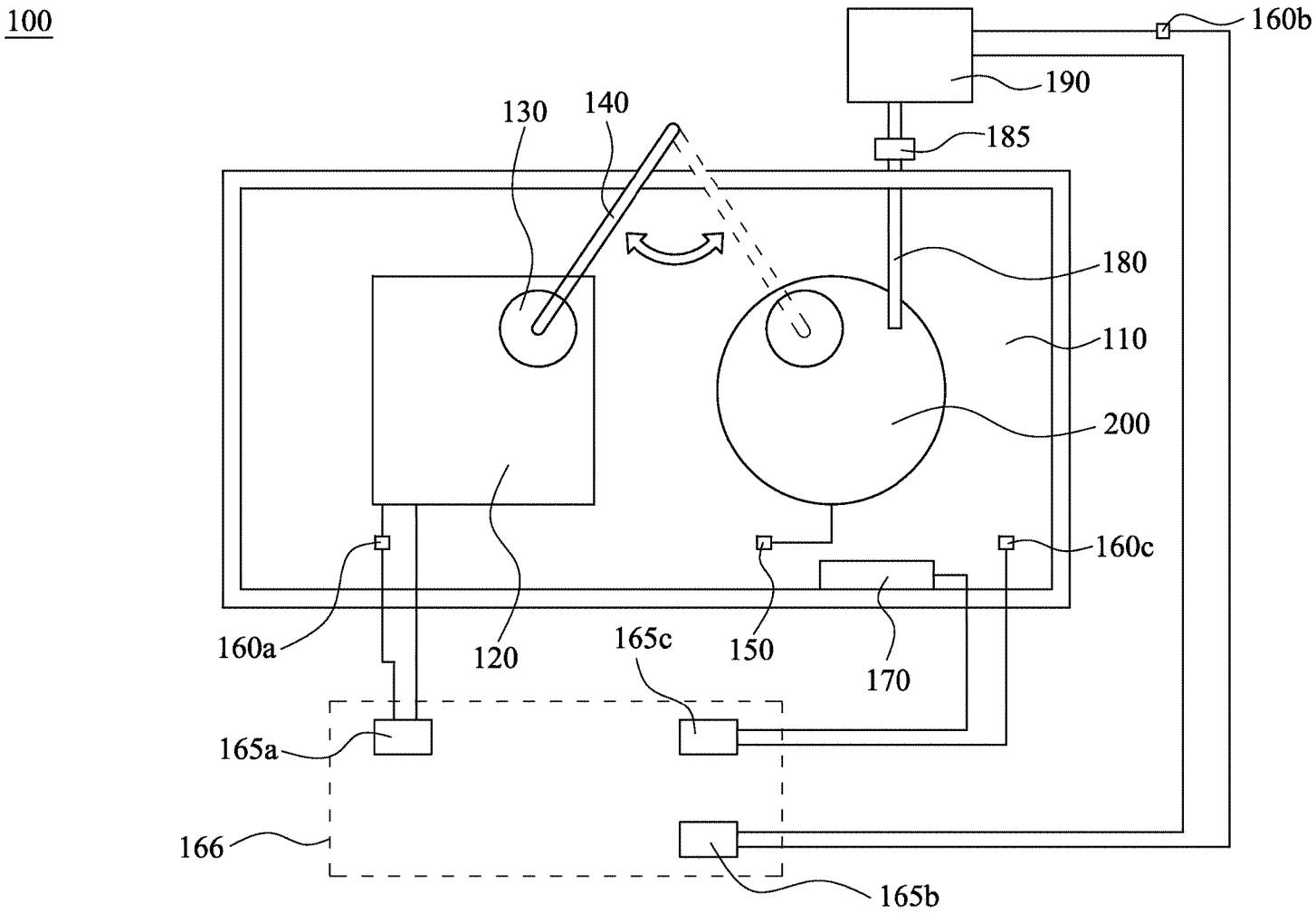
FIG. 1 is a plan view of a chemical mechanical polishing (CMP) apparatus in accordance with some embodiments of the present disclosure.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising", or "includes" and/or "including" or "has" and/or "having" when used in this specification, specify the presence of stated features, regions, integers, operations, operations, elements, and/or components, but do not preclude the presence or addition of one or more other features, regions, integers, operations, operations, elements, components, and/or groups thereof.

Furthermore, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Figure 2:
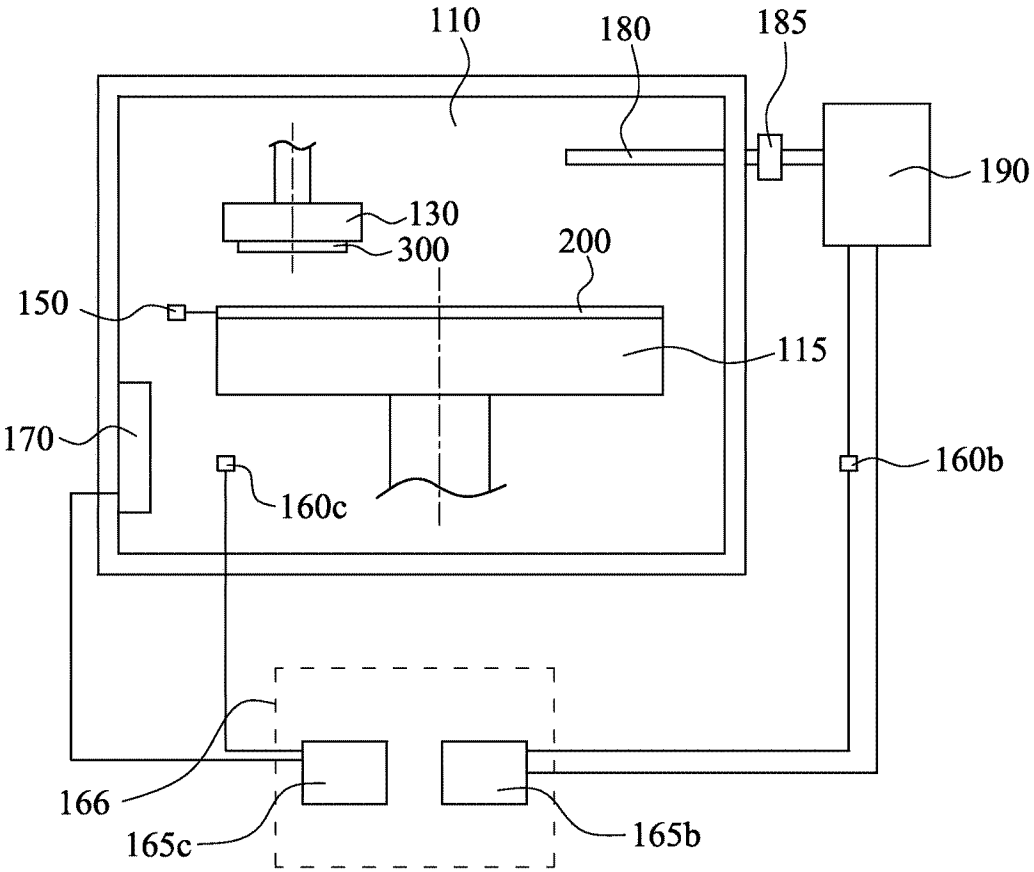
FIG. 2 is a side view of the chemical mechanical polishing apparatus of FIG. 1 before operation, in which the wafer heater and the moving mechanism are blocked.

Reference is made to FIGS. 1-2. FIG. 1 is a plan view of a chemical mechanical polishing (CMP) apparatus 100 in accordance with some embodiments of the present disclosure. FIG. 2 is a side view of the chemical mechanical polishing apparatus 100 of FIG. 1 before operation, in which the wafer heater 120 and the moving mechanism 140 are blocked. As shown in FIGS. 1-2, the chemical mechanical polishing apparatus 100 includes a processing chamber 110, a platen 115, a wafer heater 120 and a carrier head 130. The platen 115 is disposed in the processing chamber 110 and is configured to allow a polishing pad 200 to be disposed thereon. The wafer heater 120 is disposed in the processing chamber 110 and is configured to heat a wafer 300. The carrier head 130 is disposed in the processing chamber 110 and is configured to hold the heated wafer 300 against the polishing pad 200. In some embodiments, the wafer heater 120 is a wafer hot plate.

To be more specific, as shown in FIG. 1, before the operation of the chemical mechanical polishing apparatus 100, the wafer 300 is thermally connected with the wafer heater 120 and is heated by the wafer heater 120. In other words, before the wafer 300 contacts the polishing pad 200, the wafer 300 is heated up to a temperature as designed in advance according to actual situations.

In some embodiments, the chemical mechanical polishing apparatus 100 further includes a moving mechanism 140. As shown in FIG. 1, the moving mechanism 140 is coupled with the carrier head 130 to allow the carrier head 130 to be moved at least between the wafer heater 120 and the polishing pad 200. In this way, after the wafer 300 is heated up to the temperature as designed in advance by the wafer heater 120, the heated wafer 300 can be moved by the moving mechanism 140 to be against the polishing pad 200.

In practical applications, the chemical mechanical polishing apparatus 100 further includes a slurry supplier 180 and a slurry heater 190. The slurry supplier 180 is disposed in the processing chamber 110 and is configured to supply the slurry 400 onto the polishing pad 200. The slurry heater 190 is configured to be thermally connected to the slurry 400 and is configured to heat the slurry 400.

In practical applications, the slurry 400 is delivered from the slurry heater 190 to the slurry supplier 180 through a valve manifold box 185. The valve manifold box 185 is connected between the slurry heater 190 and the slurry supplier 180. The valve manifold box 185 works to control the frequency and the amount of slurry 400 to be delivered to the slurry supplier 180 from the slurry heater 190. However, the valve manifold box 185 is optional and may be omitted in some embodiments.

Figure 3:
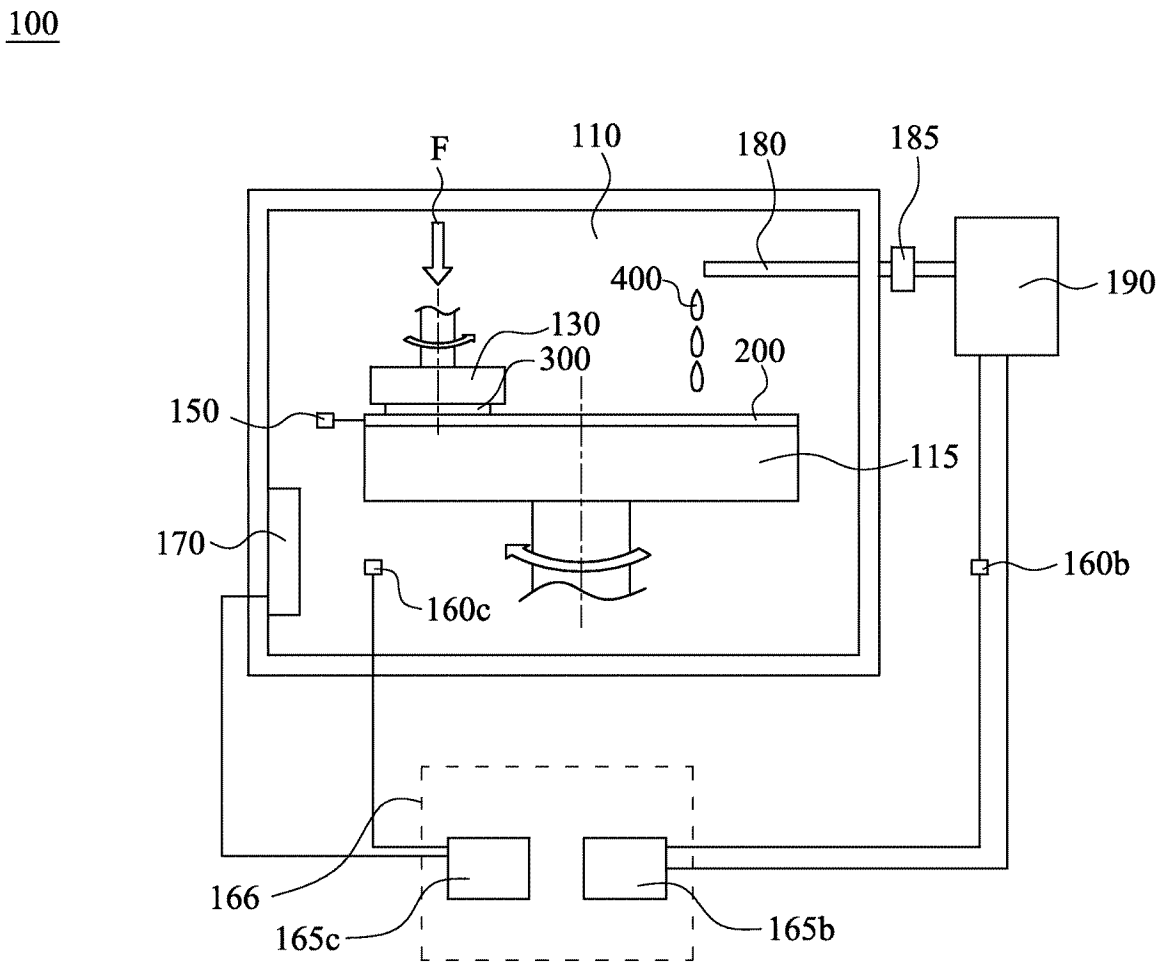
FIG. 3 is a side view of the chemical mechanical polishing apparatus of FIG. 1 during operation, in which the wafer heater and the moving mechanism are blocked.

Reference is made to FIG. 3. FIG. 3 is a side view of the chemical mechanical polishing apparatus 100 of FIG. 1 during operation, in which the wafer heater 120 and the moving mechanism 140 are blocked. As shown in FIG. 3, during the operation of the chemical mechanical polishing apparatus 100, the carrier head 130 is driven by a force F such that the wafer 300 is pressed against the polishing pad 200. On the other hand, the heated slurry 400 is supplied onto the polishing pad 200 by the slurry supplier 150 and at least one of the carrier head 130 and the platen 115 is rotated. This means at least one of the wafer 300 and the polishing pad 200 is rotated, causing the wafer 300 and the polishing pad 200 to rub against each other. In some embodiments, both of the carrier head 130 and the platen 115 are rotated. In other words, both of the wafer 300 and the polishing pad 200 are rotated. With the heated slurry 400 supplied onto the polishing pad 130 in addition to the force F exerted by the carrier head 130 to the wafer 300 against the polishing pad 200, the wafer 300 being rubbed against the polishing pad 200 is thus polished. In other words, the polishing action to the wafer 300 is carried out in a partially mechanical and a partially chemical manner. The cooperation between the slurry 400 and the polishing pad 200 removes material on the wafer 300 and tends to even out any irregular topography, making the wafer 300 to be flat or planar. In practice, the chemical reaction caused by the slurry 400 takes places and increases the material removal rate to the wafer 300.

In addition, as shown in FIGS. 1-3, the chemical mechanical polishing apparatus 100 further includes a pad heater 150. The pad heater 150 is disposed in the processing chamber 110 and is thermally connected to the polishing pad 200. The pad heater 150 is configured to heat the polishing pad 200. In some embodiments, before the operation of the chemical mechanical polishing apparatus 100, the pad heater 150 heats the polishing pad 200 such that the temperature of the polishing pad 200 is increased to a temperature designed in advance according to actual situations. In practical applications, the temperature for the wafer 300 designed in advance is substantially the same as the temperature for the polishing pad 200 designed in advance. In other words, the temperature to which the wafer 300 is heated up by the wafer heater 120 is substantially the same as the temperature to which the polishing pad 200 is heated up by the pad heater 150. In this way, before the wafer 300 gets into contact with the polishing pad 200, the wafer 300 and the polishing pad 200 are already heated up to substantially the same temperature. This means the thermal gradient between the wafer 300 and the polishing pad 200 is minimized. Thermal shock may occur when a thermal gradient causes different parts of an object to expand by different amounts. This differential expansion can be understood equivalently in terms of stress or of strain. Consequently, the object can be deformed or damaged due to the thermal stress developed. Since the thermal gradient between the wafer 300 and the polishing pad 200 is minimized as mentioned above, when the wafer 300 gets into contact with the polishing pad 200, the chance for a thermal shock to the wafer 300 is thus minimized. As a result, the wafer 300 is protected from thermal shock during the operation of the chemical mechanical polishing apparatus 100.

The removal rate to the wafer 300 refers to the amount of material of the wafer 300 being removed in a minute (in practice, the unit for the removal rate can be "A/min"), while the polishing time refers to the time period that the chemical mechanical polishing apparatus 100 has operated (in practice, the unit for the polishing time can be "s"). In general, when the polishing time increases, the removal rate to the wafer 300 increases correspondingly. The reason is that when at least one of the carrier head 130 and the platen 115 rotates, and hence at least one of the wafer 300 and the polishing pad 200 rotates and rubs against each other, heat due to friction between the wafer 300 and the polishing pad 200 is produced. This heat produced due to friction between the wafer 300 and the polishing pad 200 facilitates the chemical reaction of the slurry 400 with the wafer 300, thus the removal rate to the wafer 300 is increased correspondingly. In other words, a higher temperature of the wafer 300 and the polishing pad 200 means a faster removal rate to the wafer 300.

With the wafer 300 already heated up by the wafer heater 120 and the polishing pad 200 already heated up by the pad heater 150, during the operation of the chemical mechanical polishing apparatus 100, the removal rate to the wafer 300 starts at a higher removal rate. As the polishing time elapses, the removal rate to the wafer 300 is increased correspondingly and becomes steady. This means, the polishing action to the wafer 300 by the chemical mechanical polishing apparatus 100 becomes more efficient. The stage before the removal rate reaches the steady rate is called the transient stage. In other words, in the transient stage, the polishing action to the wafer 300 by the chemical mechanical polishing apparatus 100 is relatively less efficient. Since the chemical mechanical polishing apparatus 100 starts with a higher removal rate with the wafer 300 already heated up by the wafer heater 120 and the polishing pad 200 already heated up by the pad heater 150 before the operation of the chemical mechanical polishing apparatus 100, the polishing time elapsed for the removal rate to the wafer 300 to reach the steady rate becomes relatively shorter. In other words, the time period of the transient stage is reduced. Consequently, the overall efficiency of the chemical mechanical polishing apparatus 100 is increased.

In some embodiments, the wafer heater 120 heats up the wafer 300 to a specific temperature and the pad heater 150 heats up the polishing pad 200 to the same temperature before the operation of the chemical mechanical polishing apparatus 100, such that the operation of the chemical mechanical polishing apparatus 100 starts with the steady removal rate. In this way, the time period of the transient stage is further reduced, and thus the overall efficiency of the chemical mechanical polishing apparatus 100 is also further increased.

In order to guarantee that the wafer heater 120 can heat the wafer 300 to the temperature designed in advance such that the thermal gradient between the wafer 300 and the polishing pad 200 is minimized as mentioned above, the chemical mechanical polishing apparatus 100 further includes a thermal sensor **160*a* and a controller 165*a*. In some embodiments, as shown in FIG. 1, the thermal sensor 160*a* is disposed in the processing chamber 110 and is configured to detect the temperature of the wafer heater 120. Meanwhile, the controller 165*a* is configured to control the wafer heater 120 to decrease the temperature difference between the wafer 300 and the polishing pad 200 according to the detected temperature of the wafer heater 120 by the thermal sensor 160*a***.

To be more specific, when the temperature of the wafer heater 120 is detected by the thermal sensor 160*a* to be lower than a certain temperature such that the temperature designed for the wafer 300 cannot be achieved by the wafer heater 120, the controller 165*a* will accordingly increase the temperature of the wafer heater 120. Consequently, the temperature difference, i.e., the thermal gradient, between the wafer 300 and the polishing pad 200 is decreased. In this way, the operation of the chemical mechanical polishing apparatus 100 can be maintained at a high temperature. In other words, the removal rate to the wafer 300 and thus the efficiency of the chemical mechanical polishing apparatus 100 is maintained.

As mentioned above, the slurry 400 supplied onto the polishing pad 200 by the slurry supplier 180 is already heated to the temperature as designed in advance. Therefore, the thermal gradient between the slurry 400 and the polishing pad 200 is minimized. In this way, when the heated slurry 400 is supplied onto the polishing pad 200, the temperature of the polishing pad 200 already heated by the pad heater 150 will not be decreased by the heated slurry 400. As a result, the temperature at which the wafer 300 is polished by the polishing pad 200 is maintained.

On the other hand, as shown in FIGS. 1-3, the chemical mechanical polishing apparatus 100 further includes a thermal sensor 160*b* and a controller 165*b*. In some embodiments, the thermal sensor 160*b* is configured to detect the temperature of the slurry 400. Meanwhile, the controller 165*b* is configured to control the slurry heater 190 to heat the slurry 400 to the temperature lower than an activation temperature of the slurry 400 according to the detected temperature of the slurry 400 by the thermal sensor 160*b*. To be more specific, at the activation temperature, the slurry 400 is activated for the chemical reaction with the wafer 300.

For instance, when the temperature of the slurry 400 is detected by the thermal sensor 160*b* to be lower than the temperature as designed in advance during the operation of the chemical mechanical polishing apparatus 100, the controller 165*b* will control the slurry heater 190 to heat the slurry 400 up to the temperature as designed in advance. As mentioned above, the temperature of the slurry 400 as designed in advance is generally lower than the activation temperature of the slurry 400 such that the slurry 400 is not activated before being supplied onto the polishing pad 200 by the slurry supplier 180.

On the other hand, in order to maintain the temperature of the processing chamber 110 so as to facilitate the maintenance of the temperature of the wafer 300 after heated up by the wafer heater 120, the temperature of the polishing pad 200 after heated up by the pad heater 150 and the temperature of the slurry 400 after heated up by the slurry heater 190, the chemical mechanical polishing apparatus 100 further includes a chamber heater 170. In some embodiments, as shown in FIGS. 1-3, the chamber heater 170 is disposed in the processing chamber 110 and is thermally connected to an environment in the processing chamber 110. The chamber heater 170 is configured to heat the environment in the processing chamber 110. In practical applications, the chamber heater 170 is a radiation board.

In addition, as shown in FIGS. 1-3, the chemical mechanical polishing apparatus 100 further includes a thermal sensor 160*c* and a controller 165*c*. In some embodiments, the thermal sensor 160*c* is disposed in the processing chamber 110 and is configured to detect the temperature of the environment in the processing chamber 110. Meanwhile, the controller 165*c* is configured to control the chamber heater 170 to decrease a temperature difference between the environment in the processing chamber 110 and the polishing pad 200 according to the detected temperature of the environment in the processing chamber 110. In some embodiments, the controller 165*a*, the controller 165*b* and the controller 165*c* can be disposed on a single control panel 166. However, this does not intend to limit the present disclosure.

For instance, when the temperature of the environment in the processing chamber 110 is detected by the thermal sensor 160*c* to be lower than a certain temperature during the operation of the chemical mechanical polishing apparatus 100, the controller 165*c* will control the chamber heater 170 to increase the temperature of the environment in the processing chamber 110 so as to decrease the temperature difference, i.e., the thermal gradient, between the environment in the processing chamber 110 and the polishing pad 200 according to the detected temperature of the environment in the processing chamber 110. In practical applications, the temperature of the environment in the processing chamber 110 to which the chamber heater 170 heats up to is substantially the same as the temperature designed for the wafer 300 in advance. In this way, the operation of the chemical mechanical polishing apparatus 100 can be maintained at a high temperature. In other words, the removal rate to the wafer 300 and thus the efficiency of the chemical mechanical polishing apparatus 100 is maintained.

Generally speaking, for the operation of the chemical mechanical polishing apparatus 100, the temperature designed for the wafer 300 in advance is substantially the same as the temperature designed for the polishing pad 200 designed in advance, as mentioned above. On the other hand, the temperature of the environment in the processing chamber 110 to which the chamber heater 170 heats up to is substantially the same as the temperature designed for the wafer 300 in advance, so as to decrease the temperature difference, i.e., the thermal gradient, between the environment in the processing chamber 110 and the wafer 300, and thus the polishing pad 200. In other words, during the operation of the chemical mechanical polishing apparatus 100, the temperature of the wafer 300, the temperature of the polishing pad 200, and the temperature of the environment in the processing chamber 110 are substantially the same. Meanwhile, as mentioned above, the temperature of the slurry 400 as designed in advance is generally lower than the activation temperature of the slurry 400 such that the slurry 400 is not activated before being supplied onto the polishing pad 200 by the slurry supplier 180. To be more specific, during the operation of the chemical mechanical polishing apparatus 100, the temperature of the slurry 400 supplied onto the polishing pad 200 by the slurry supplier 180 is lower than the temperature of the wafer 300, the temperature of the polishing pad 200, and the temperature of the environment in the processing chamber 110. In other words, the temperature of the wafer 300, the temperature of the polishing pad 200, and the temperature of the environment in the processing chamber 110 is higher than the temperature of the slurry 400 supplied onto the polishing pad 200 by the slurry supplier 180 during the operation of the chemical mechanical polishing apparatus 100.

With reference to the chemical mechanical polishing apparatus 100 as mentioned above, the embodiments of the present disclosure further provide a chemical mechanical polishing method. The method includes the following steps (it is appreciated that the sequence of the steps and the sub-steps as mentioned below, unless otherwise specified, all can be adjusted according to the actual situations, or even executed at the same time or partially at the same time):

(1) decreasing the temperature difference between the wafer 300 and the polishing pad 200.

(2) holding the wafer 300 against the polishing pad 200.

(3) rotating at least one of the wafer 300 and the polishing pad 200.

In this way, since the temperature difference, i.e., the thermal gradient, between the wafer 300 and the polishing pad 200 is decreased, when the wafer 300 gets into contact with the polishing pad 200, the chance for a thermal shock to the wafer 300 is thus minimized. As a result, the wafer 300 is protected from thermal shock during the operation of the chemical mechanical polishing apparatus 100. On the other hand, in some embodiments, both of the wafer 300 and the polishing pad 200 are rotated.

Furthermore, for the chemical mechanical polishing method, the step for decreasing the temperature difference between the wafer 300 and the polishing pad 200 (step 1) further includes the following step:

(1.1) disposing the wafer 300 on the wafer hot plate to heat the wafer 300. In this way, the wafer 300 is heated up by the wafer hot plate.

After the wafer 300 is disposed on the wafer hot plate and is heated by the wafer hot plate, the step of holding the wafer 300 against the polishing pad 200 (step 2) further includes the following steps:

(2.1) picking up the heated wafer 300 from the wafer hot plate.

(2.2) moving the heated wafer 300 to be against the polishing pad 200.

Afterwards, the process of chemical mechanical polishing to the wafer 300 can be started with the wafer 300 already heated up by the wafer hot plate.

In addition, in order to maintain the temperature of the environment in the processing chamber 110 such that the temperature at which the wafer 300 is chemically and mechanically polished is maintained, the chemical mechanical polishing method further includes the following step:

(4) decreasing the temperature difference between the environment where the wafer 300 is and the polishing pad 200. In practical applications, the environment in the processing chamber 110 is heated up by chamber heater 170. In some embodiments, the chamber heater 170 is a radiation board.

On the other hand, in order to increase the removal rate to the wafer 300 during the process of chemical mechanical polishing to the wafer 300, the chemical mechanical polishing method further includes the following step:

(5) increasing the temperature of the polishing pad 200 before the rotating. In practical applications, the polishing pad 200 is heated up by the pad heater 150. With the wafer 300 heated up by the wafer hot plate and the polishing pad 200 heated up by the pad heater 150, the temperature of the wafer 300 and the polishing pad 200 can be made substantially the same. Thus, the temperature difference between the wafer 300 and the polishing pad 200 is effectively decreased.

Furthermore, in order to maintain the temperature at which the wafer 300 is chemically and mechanically polished and to maintain the removal rate to the wafer 300 during the process of chemical mechanical polishing to the wafer 300, the chemical mechanical polishing method further includes the following steps:

(6) increasing the temperature of slurry 400. To be more specific, the temperature of the slurry 400 is increased to a temperature lower than the activation temperature of the slurry 400.

(7) supplying the slurry 400 with the increased temperature onto the polishing pad 200.

According to various embodiments of the present disclosure, before the operation of the chemical mechanical polishing apparatus 100, the wafer 300 is thermally connected with the wafer heater 120 and is heated by the wafer heater 120. In other words, before the wafer 300 contacts the polishing pad 200, the wafer 300 is heated up to a temperature as designed in advance according to actual situations. In some embodiments, before the operation of the chemical mechanical polishing apparatus 100, the pad heater 150 heats the polishing pad 200 such that the temperature of the polishing pad 200 is increased to a temperature designed in advance according to actual situations. In practical applications, the temperature for the wafer 300 designed in advance is substantially the same as the temperature for the polishing pad 200 designed in advance. In other words, the temperature to which the wafer 300 is heated up by the wafer heater 120 is substantially the same as the temperature to which the polishing pad 200 is heated up by the pad heater 150. In this way, before the wafer 300 gets into contact with the polishing pad 200, the wafer 300 and the polishing pad 200 are already heated up to substantially the same temperature. This means the thermal gradient between the wafer 300 and the polishing pad 200 is minimized. Since the thermal gradient between the wafer 300 and the polishing pad 200 is minimized as mentioned above, when the wafer 300 gets into contact with the polishing pad 200, the chance for a thermal shock to the wafer 300 is thus minimized. As a result, the wafer 300 is protected from thermal shock during the operation of the chemical mechanical polishing apparatus 100.

According to various embodiments of the present disclosure, the chemical mechanical polishing apparatus includes the processing chamber, the platen, the wafer heater and the carrier head. The platen is disposed in the processing chamber and is configured to allow the polishing pad to be disposed thereon. The wafer heater is disposed in the processing chamber and is configured to heat the wafer. The carrier head is disposed in the processing chamber and is configured to hold the heated wafer against the polishing pad.

According to various embodiments of the present disclosure, the chemical mechanical polishing apparatus includes the processing chamber, the platen, the carrier head and the chamber heater. The platen is disposed in the processing chamber and is configured to allow the polishing pad to be disposed thereon. The carrier head is disposed in the processing chamber and is configured to holding the wafer against the polishing pad. The chamber heater is disposed in the processing chamber and is thermally connected to the environment in the processing chamber.

According to various embodiments of the present disclosure, the chemical mechanical polishing method includes decreasing the first temperature difference between the wafer and the polishing pad, holding the wafer against the polishing pad, and rotating at least one of the wafer and the polishing pad.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A chemical mechanical polishing (CMP) method, comprising:

decreasing a first temperature difference between a wafer and a polishing pad by disposing the wafer on a wafer hot plate spaced from the polishing pad and by increasing a temperature of the wafer hot plate with a controller to heat the wafer;

separating the wafer from the wafer hot plate;

holding the wafer against the polishing pad; and rotating at least one of the wafer and the polishing pad.

2. The CMP method of claim 1, wherein the separating comprises picking up the wafer from the wafer hot plate and wherein the holding comprises moving the wafer to be against the polishing pad.

3. The CMP method of claim 1, further comprising:

decreasing a second temperature difference between an environment where the wafer is and the polishing pad.

4. The CMP method of claim 1, further comprising:

increasing a temperature of the polishing pad before the rotating.

5. The CMP method of claim 1, further comprising:

increasing a temperature of slurry; and supplying the slurry with the increased temperature onto the polishing pad.

6. The CMP method of claim 5, wherein the temperature of the slurry is increased to a temperature lower than an activation temperature of the slurry.

7. The CMP method of claim 1, further comprising heating a slurry supplier having an end portion adjacent a chamber with a slurry heater in contact with the end portion of the slurry supplier.

8. The CMP method of claim 1, further comprising moving the wafer sideward from the wafer hot plate to the polishing pad.

9. A chemical mechanical polishing (CMP) method, comprising:

decreasing a temperature difference between a wafer and a polishing pad by heating the polishing pad with a pad heater in contact with the polishing pad and by disposing the wafer on a wafer hot plate different from the pad heater and by increasing a temperature of the wafer hot plate with a controller to heat the wafer; and polishing the wafer against the polishing pad.

10. The CMP method of claim 9, further comprising heating a chamber with a chamber heater different from the wafer hot plate and the pad heater and in contact with the chamber.

11. The CMP method of claim 9, further comprising detecting a temperature of the wafer hot plate with a first thermal sensor and a temperature of the pad heater with a second thermal sensor different from the first thermal sensor.

12. The CMP method of claim 11, further comprising detecting a temperature of a chamber heater with a third thermal sensor different from the first and second thermal sensors.

13. The CMP method of claim 9, further comprising heating a slurry supplier having an end portion adjacent a chamber with a slurry heater in contact with the end portion of the slurry supplier.

14. The CMP method of claim 9, further comprising moving the wafer sideward from the wafer hot plate to the polishing pad.

15. A chemical mechanical polishing (CMP) method, comprising:

decreasing a temperature difference between a wafer and a polishing pad by controlling a temperature of a wafer hot plate configured to heat the wafer with a first controller and a temperature of a pad heater configured to heat the polishing pad with a second controller different from the first controller; and polishing the wafer against the polishing pad.

16. The CMP method of claim 15, further comprising controlling a temperature of a chamber with a third controller different from the first and second controllers.

17. The CMP method of claim 15, further comprising detecting a temperature of the wafer hot plate with a first thermal sensor and a temperature of the pad heater with a second thermal sensor different from the first thermal sensor.

18. The CMP method of claim 17, further comprising detecting a temperature of a chamber heater with a third thermal sensor different from the first and second thermal sensors.

19. The CMP method of claim 15, further comprising heating a slurry supplier having an end portion adjacent a chamber with a slurry heater in contact with the end portion of the slurry supplier.

20. The CMP method of claim 15, further comprising moving the wafer sideward from the wafer hot plate to the polishing pad.

* * * * *